US008893335B1

(12) United States Patent
Hijuelos

(10) Patent No.: US 8,893,335 B1
(45) Date of Patent: Nov. 25, 2014

(54) COVER BEDDING SET ASSEMBLY

(71) Applicant: Veronica Hijuelos, Miami, FL (US)

(72) Inventor: Veronica Hijuelos, Miami, FL (US)

( * ) Notice: Subject to any disclaimer, the term of this patent is extended or adjusted under 35 U.S.C. 154(b) by 0 days.

(21) Appl. No.: 14/010,653

(22) Filed: Aug. 27, 2013

(51) Int. Cl.
*A47C 31/00* (2006.01)
*A47C 29/00* (2006.01)
*A47C 21/00* (2006.01)

(52) U.S. Cl.
CPC ..... *A47C 21/00* (2013.01)
USPC ..... 5/658; 5/113

(58) Field of Classification Search
USPC ..... 5/414, 113, 424, 658; 135/96, 156, 135/125–128, 137, 138, 144, 119, 906
See application file for complete search history.

(56) References Cited

U.S. PATENT DOCUMENTS

| | | | | | |
|---|---|---|---|---|---|
| 368,206 | A | * | 8/1887 | Hardy | 135/133 |
| 556,235 | A | * | 3/1896 | Wright | 135/120.2 |
| 620,008 | A | * | 2/1899 | Woodward | 135/153 |
| 654,972 | A | * | 7/1900 | Haack | 135/157 |
| 739,352 | A | * | 9/1903 | Schuette | 5/414 |
| 744,487 | A | * | 11/1903 | Childress | 135/121 |
| 775,972 | A | * | 11/1904 | Henderson | 135/96 |
| 860,379 | A | * | 7/1907 | Hodes | 135/88.02 |
| 947,341 | A | * | 1/1910 | Lehman | 5/113 |
| 1,303,619 | A | * | 5/1919 | Vance | 135/121 |
| 1,321,352 | A | * | 11/1919 | Anderson | 5/113 |
| 1,433,457 | A | * | 10/1922 | Hunter | 5/113 |
| 1,463,267 | A | * | 7/1923 | Hosner | 5/113 |
| 1,541,215 | A | * | 6/1925 | Hastings | 135/115 |
| 1,696,286 | A | * | 12/1928 | Smith | 5/119 |
| 1,707,647 | A | * | 4/1929 | Still | 135/90 |
| 1,892,378 | A | * | 12/1932 | Bernstein | 135/93 |
| 1,909,467 | A | * | 5/1933 | Hirose et al. | 135/96 |
| 2,586,247 | A | * | 2/1952 | Mover | 5/97 |
| 3,266,063 | A | | 8/1966 | Shapiro | |
| 3,295,150 | A | | 1/1967 | Shapiro et al. | |
| 4,063,566 | A | * | 12/1977 | Millerioux | 135/97 |
| 4,198,996 | A | * | 4/1980 | Keable et al. | 135/128 |
| 4,466,425 | A | * | 8/1984 | Maggi | 5/600 |
| 4,531,330 | A | * | 7/1985 | Phillips | 52/2.21 |
| 4,765,006 | A | * | 8/1988 | Jackson et al. | 5/658 |
| 4,800,600 | A | | 1/1989 | Baum | |
| 4,852,598 | A | | 8/1989 | Griesenbeck | |
| 4,888,837 | A | | 12/1989 | Wang | |
| 4,890,346 | A | * | 1/1990 | Rist | 5/658 |
| 5,044,024 | A | * | 9/1991 | Del Rose | 5/400 |
| 5,072,694 | A | * | 12/1991 | Haynes et al. | 119/482 |
| 5,210,888 | A | * | 5/1993 | Canfield | 5/113 |

(Continued)

FOREIGN PATENT DOCUMENTS

GB 2208794 A 4/1989

*Primary Examiner* — William Kelleher
*Assistant Examiner* — Eric Kurilla
(74) *Attorney, Agent, or Firm* — Albert Bordas, P.A.

(57) ABSTRACT

The present invention is a cover bedding set assembly, having first and second sidewall cover assemblies. The first sidewall cover assembly has at least one first channel housing a first band assembly and the second sidewall cover assembly has at least one second channel housing a second band assembly. A footboard cover assembly has at least one third channel housing a third band assembly, and a headboard cover assembly has at least one fourth channel housing a fourth band assembly. The first and second sidewall cover assemblies, the footboard cover assembly, and the headboard cover assembly transform into predetermined shapes to disguise a bed assembly when assembled, whereby the at least one first, second, third, and fourth channels define a shape of the first, second, third, and fourth band assemblies housed within.

18 Claims, 11 Drawing Sheets

(56) References Cited

U.S. PATENT DOCUMENTS

| | | | | |
|---|---|---|---|---|
| 5,303,434 | A * | 4/1994 | Arnold | 135/138 |
| 5,502,927 | A * | 4/1996 | Hammerton | 52/218 |
| 5,636,478 | A * | 6/1997 | Chen | 52/2.11 |
| 5,645,096 | A | 7/1997 | Hazinski et al. | |
| D401,802 | S | 12/1998 | Roth | |
| 5,845,958 | A * | 12/1998 | Rudys et al. | 296/136.08 |
| 5,915,399 | A * | 6/1999 | Yang | 135/88.01 |
| D417,481 | S * | 12/1999 | Schwartz et al. | D21/836 |
| D428,961 | S * | 8/2000 | Orphan et al. | D21/836 |
| 6,109,280 | A * | 8/2000 | Custer | 135/116 |
| D430,638 | S | 9/2000 | Allen | |
| 6,216,291 | B1 * | 4/2001 | Eads et al. | 5/424 |
| 6,371,144 | B1 | 4/2002 | Ragatz | |
| D469,496 | S | 1/2003 | Schur | |
| 6,550,083 | B1 * | 4/2003 | LaMantia | 5/97 |
| 6,565,139 | B2 * | 5/2003 | Bayerle et al. | 296/77.1 |
| 6,578,214 | B2 | 6/2003 | Peftoulidis | |
| 6,644,329 | B2 * | 11/2003 | Tomason | 135/96 |
| 6,952,844 | B2 | 10/2005 | Danaher | |
| 7,174,584 | B2 | 2/2007 | Danaher | |
| 7,263,731 | B1 * | 9/2007 | Stepanek et al. | 5/413 R |
| D560,743 | S | 1/2008 | Bernart | |
| 7,392,555 | B2 | 7/2008 | Danaher | |
| 7,430,770 | B2 * | 10/2008 | Ramirez | 5/424 |
| 7,743,442 | B2 | 6/2010 | Maloney et al. | |
| 8,087,110 | B1 * | 1/2012 | Park et al. | 5/414 |
| 8,256,044 | B1 * | 9/2012 | Park et al. | 5/414 |
| 8,321,980 | B2 | 12/2012 | Maloney | |
| 8,413,269 | B1 * | 4/2013 | Vail | 5/414 |
| 2001/0010232 | A1 * | 8/2001 | Zheng | 135/126 |
| 2003/0106578 | A1 * | 6/2003 | Cornist | 135/137 |
| 2003/0111102 | A1 * | 6/2003 | Henley et al. | 135/125 |
| 2003/0168093 | A1 * | 9/2003 | Zheng | 135/126 |
| 2003/0177576 | A1 * | 9/2003 | LaMantia | 5/97 |
| 2005/0044630 | A1 * | 3/2005 | Danaher | 5/414 |
| 2005/0126616 | A1 * | 6/2005 | Zheng | 135/126 |
| 2005/0205123 | A1 * | 9/2005 | Zheng | 135/126 |
| 2005/0235418 | A1 * | 10/2005 | Jacques et al. | 5/424 |
| 2005/0274406 | A1 * | 12/2005 | Danaher | 135/126 |
| 2006/0020159 | A1 * | 1/2006 | Ellen | 600/21 |
| 2006/0064818 | A1 * | 3/2006 | Danaher | 5/414 |
| 2006/0137729 | A1 * | 6/2006 | Kline | 135/96 |
| 2007/0113340 | A1 * | 5/2007 | Yang | 5/486 |
| 2007/0180615 | A1 * | 8/2007 | Yang | 5/414 |
| 2007/0246093 | A1 * | 10/2007 | Zheng | 135/128 |
| 2007/0271698 | A1 * | 11/2007 | Cyr | 5/414 |
| 2009/0007949 | A1 * | 1/2009 | Zheng | 135/126 |
| 2009/0025766 | A1 * | 1/2009 | Kline | 135/96 |
| 2010/0083995 | A1 * | 4/2010 | Sanders | 135/96 |
| 2010/0126546 | A1 * | 5/2010 | Chen | 135/126 |
| 2011/0061701 | A1 * | 3/2011 | Perez | 135/96 |
| 2011/0296612 | A1 * | 12/2011 | Papp et al. | 5/424 |
| 2012/0125390 | A1 * | 5/2012 | Damas | 135/115 |

* cited by examiner

COVER BEDDING SET ASSEMBLY

BACKGROUND OF THE INVENTION

1. Field of the Invention

The present invention relates to bedding accessories, and more particularly, to cover bedding set assemblies for beds.

2. Description of the Related Art

Applicant believes that one of the closest references corresponds to U.S. Pat. No. 8,321,980 B2 issued to Maloney on Dec. 4, 2012 for Flexible System for Surrounding a Perimeter and Covering a Top Surface of a Mattress. However, it differs from the present invention because Maloney teaches a flexible system for surrounding a perimeter and covering a top surface of a mattress. The flexible system supports one or more appendage(s) of a character. The flexible system includes a textile or fabric frame for covering portions of a head side, a foot side and intermediate sides of the mattress. The textile or fabric frame forms an opening around a portion of a top surface of the mattress, where the opening has an inner peripheral edge. The flexible system further includes a cover sheet positioned over the top surface, and having an outer peripheral edge that is removably attached to the inner peripheral edge of the opening of the frame. The appendage (s) of the character are supported on the textile or fabric frame at one or more of the head side, the foot side and the intermediate sides of the mattress.

Applicant believes that another reference corresponds to U.S. Pat. No. 7,743,442 B2 issued to Maloney, et al. on Jun. 29, 2010 for System and Method for Enhancing the Safety of a Sleeping Arrangement for a Child on a Bed. However, it differs from the present invention because Maloney, et al. teaches a system for enhancing the safety of a sleeping arrangement for a child on a bed. The bed includes a mattress and a box spring. The system includes a frame to enclose a perimeter of the mattress and the box spring. The frame includes a plurality of sections, which are removably attached at respective junctures with hook and loop fasteners. An outer surface of the frame is formed from a plush material. The plurality of sections includes a pair of side sections, which extend along a respective pair of opposing side surfaces of the mattress and the box spring. The pair of side sections includes a respective vertical bumper configured to extend from a top portion of the side sections by a predetermined height, to prevent the child on the bed from passing outside the side surfaces of the mattress and falling from the mattress.

Applicant believes that another reference corresponds to U.S. Pat. No. 7,392,555 B2 issued to Danaher on Jul. 1, 2008 for Bed-Tent. However, it differs from the present invention because Danaher teaches a bed-tent that provides an enclosure over a mattress. The tents form a canopy having panels each with a resilient, strip frame member and a sheet of flexible fabric. Retainers secure the canopy on the mattress. In some forms, a frame member disposed externally of the canopy helps to hold the panels and canopy upright. In other forms, the frame members are configured so that no additional support is needed to hold the panels and/or bed tent upright on a bed. The frame members may be readily adapted for use in curved or rectilinear panels to permit a wide range of bed tent designs and features. The frame members preferably can be twisted or wound into flat coils of reduced diameter or other form so that the entire canopy can be conveniently stored in a small package.

Applicant believes that another reference corresponds to U.S. Pat. No. 7,174,584 B2 issued to Danaher on Feb. 13, 2007 for Bed-Tent. However, it differs from the present invention because Danaher teaches a bed-tent that provides an enclosure over a mattress. The tent forms a canopy having spaced-apart panels and a flexible cover extending between the panels. Each panel includes a hoop of flexible, resilient, strip material and a sheet of flexible fabric in the space within the hoop. Retainers secure the canopy on the mattress. A supporting frame holds the panels erect. The frame has stanchions disposed externally of the canopy and releasably connected to the panels. A frame member externally of the canopy above the cover holds the stanchions upright. The hoops can be twisted or wound into flat coils of reduced diameter so that the entire canopy can be conveniently stored in a small package. The legs and the frame member are made of segments that are normally held together by elastic cords. The segments can be pulled apart and separated for storage in a convenient package Applicant believes that another reference corresponds to U.S. Pat. No. 6,952,844 B2 issued to Danaher on Oct. 11, 2005, for Bed-Tent. However, it differs from the present invention because Danaher teaches a bed-tent that provides an enclosure over a mattress. The tent forms a canopy having spaced-apart panels and a flexible cover extending between the panels. Each panel includes a hoop of flexible, resilient, strip material and a sheet of flexible fabric in the space within the hoop. Retainers secure the canopy on the mattress. A supporting frame holds the panels erect. The frame has stanchions disposed externally of the canopy and releasably connected to the panels. A frame member externally of the canopy above the cover holds the stanchions upright. The hoops can be twisted or wound into flat coils of reduced diameter so that the entire canopy can be conveniently stored in a small package. The legs and the frame member are made of segments that are normally held together by elastic cords. The segments can be pulled apart and separated for storage in a convenient package Applicant believes that another reference corresponds to U.S. Pat. No. 6,578,214 B2 issued to Peftoulidis on Jun. 17, 2003 for Sport Beds. However, it differs from the present invention because Peftoulidis teaches a sport bed comprising various sport-shaped bed designs consisting of a frame, mattress, motion sensors, rechargeable battery cell and dimmer night-light. The designs have shapes such as a football, baseball, soccer, basketball, and other sport shapes. The bed also comprises storage drawers located in various positions according to the design. Each bed contains battery-operated motion sensors, which trigger a night dimmer light. When the sensor indicates a child has laid down in the bed, the dimmer responds to the signal and the light goes on. Within a short period of time, the light slowly dims until it is fully out. If the child should sit up, the sensor will react and the light will go on. The mattress fits down inside a recess in the frame and the headboard.

Applicant believes that another reference corresponds to U.S. Pat. No. 6,371,144 B1 issued to Ragatz on Apr. 16, 2002 for Car Tent. However, it differs from the present invention because Ragatz teaches a tent having the overall appearance and shape of a NASCAR vehicle, having fabric suspended between two sections of flexible pipe manufactured from PVC or fiberglass. The flexible tube sections cross forming two gentle smooth curves which when viewed from above form a flattened X. The bottom panel of the tent is a rectangle which has two parallel long sides and two parallel short sides and which may be staked to the ground. Two sides extend upwardly from the two long sides of the rectangle, and have the appearance of the sides of an automobile. The front bumper, the hood, the front windshield, the car top, the back window, rear spoiler and the rear bumper are formed by a panel which is joined to the tent bottom and the tent sides having printed indicia thereon representative of the various automotive parts. The driver's side of the car has a door formed by a zipper. A screen flap within the door forms an inner screen door. Additional ventilation is provided by screen panels, which underlie flaps forming the front and rear windshields.

Applicant believes that another reference corresponds to U.S. Pat. No. 4,888,837 B1 issued to Wang on Dec. 26, 1989 for Toy Bed Transformers. However, it differs from the present invention because Wang teaches a toy bed transformer including a mattress and various inflatable toy accessories having shapes, such as, an airplane nose, an airplane wing, a cockpit, a rocket, a missile, a tire, a propeller, and a jet engine. The mattress and the inflatable toy accessories have attaching bands thereon and can be attached together by the attaching bands to form different objects mimicking for example, a car, an aircraft, and a tank, according to a child's own imaginative ideas.

Applicant believes that another reference corresponds to U.S. Pat. No. 4,852,598 B1 issued to Griesenbeck on Aug. 1, 1989 for Bed Tent. However, it differs from the present invention because Griesenbeck teaches a bed tent with a base portion snugly fitted around a mattress and a canopy portion connected to the base portion along its lower periphery is supported in an upright position over the mattress to provide an enclosure having a bottom surface area substantially coextensive with the surface area of the mattress and an opening for ingress and egress.

Applicant believes that another reference corresponds to U.S. Pat. No. 4,800,600 B1 issued to Baum on Jan. 31, 1989 for Decorative Crib Bumper. However, it differs from the present invention because Baum teaches a fancifully-shaped crib bumper having stuffed legs serving in the traditional role of a crib bumper, as well as stuffed arms that provide added protection higher up on the side of a crib. The tubular arms and legs of the novel crib bumper are stuffed by using rolled fiberfill batting, which is placed in an insertion device that may be either preformed in a tubular shape or may comprise a flexible sheet material that is rolled around the rolled fiberfill batting. The use of the insertion device permits the rolled fiberfill batting to be inserted into a crib bumper leg or arm in a simple, easy manner, and is then removed, leaving the fiberfill batting in place. The fiberfill batting is then securely attached to the outer casing of the crib bumper by stitching.

Applicant believes that another reference corresponds to U.S. Pat. No. 5,645,096 B1 issued to Hazinski et al. on Jul. 8, 1997 for Non-Symmetrical Loop Pop Up Tent Structure and Method. However, it differs from the present invention because Hazinski et al. teaches a pop-up tent is configured to have high substantially vertical walls with a floor area only slightly larger than the walled-in area, by the unique usage of non-symmetrical loops. Thus, a pop-up tent is provided, which can be used for both living and sleeping purposes. A method of folding the tent into a flat circular shape for ease of storage and transportation is disclosed and claimed.

Applicant believes that another reference corresponds to U.S. Pat. No. 3,295,150 B1 issued to Shapiro, et al. on Jan. 3, 1967 for Decorative Bed Cover. However, it differs from the present invention because Shapiro, et al. teaches a decorative bed cover which, in combination with a bed, consists of bed-bed covering combination to realistically resemble an automobile.

Applicant believes that another reference corresponds to U.S. Pat. No. 3,266,063 B1 issued to Shapiro on Jul. 12, 1965 for Bedspread. However, it differs from the present invention because Shapiro teaches a bedspread, which, when placed upon a bed, causes the bed to resemble a three dimensional object of another type.

Applicant believes that another references correspond to U.S. Pat. Nos. D560743 S issue to Bernart on Jan. 29, 2008 for Baseball themed Tent; D469496 S issued to Schur on Jan. 28, 2003 for Combined Children's Play Tent with Attached Bed Sheet Therefor; D430638 S issued to Allen on Sep. 5, 2000 for Tent With Race Car Motif; D401802 S issued to Roth on Dec. 1, 1998 for Pillowcase. All of them showing designs for tents different from that of Applicant.

Applicant believes that another reference corresponds to GB Patent No. 2208794 A issued to Wang on Apr. 19, 1989 for Toy Bed Transformer. However, it differs from the present invention because Wang teaches a toy bed transformer comprises a mattress and a number of inflatable toy accessories of shapes such as an aeroplane nose, an aeroplane wing, a cockpit, a rocket, a missile, a tyre, a propeller and a jet engine. The mattress and toy accessories have attachment means enabling them to be attached to one another. The mattress serves as a main body to which the toy accessories can be attached to turn the mattress into, for example, a car, an aircraft and a tank.

Other patents describing the closest subject matter provide for a number of more or less complicated features that fail to solve the problem in an efficient and economical way. None of these patents suggest the novel features of the present invention.

SUMMARY OF THE INVENTION

The present invention is a cover bedding set assembly, comprising first and second sidewall cover assemblies. The first sidewall cover assembly comprises at least one first channel housing a first band assembly and the second sidewall cover assembly comprises at least one second channel housing a second band assembly. A footboard cover assembly comprises at least one third channel housing a third band assembly, and a headboard cover assembly comprises at least one fourth channel housing a fourth band assembly. The first and second sidewall cover assemblies, the footboard cover assembly, and the headboard cover assembly transform into predetermined shapes to disguise a bed assembly when assembled, whereby the at least one first, second, third, and fourth channels define a shape of the first, second, third, and fourth band assemblies housed within.

The first, second, third, and fourth band assemblies expand outwardly within the at least one first, second, third, and fourth channels respectively. The first, second, third, and fourth band assemblies are made of a flexible and resilient material that keep their shape when not being deformed by a force of a predetermined magnitude. The first, second, third, and fourth band assemblies are made of a metallic material. The first and second sidewall cover assemblies, the footboard cover assembly, and the headboard cover assembly are assembled onto the bed assembly. The bed assembly may comprise a headboard assembly having posts and a headboard, and may comprise a footboard assembly having posts and a footboard. In addition, the bed assembly may comprise a box spring and a mattress.

The first and second sidewall cover assemblies comprise first and second locks that snap and/or secure to each underneath the mattress. The first sidewall cover assembly further comprises at least one first zipper section, and the second sidewall cover assembly further comprises at least one second zipper section. The footboard cover assembly further comprises at least one third zipper section. The headboard cover assembly further comprises at least one fourth zipper section.

The at least one third zipper section of the footboard cover assembly mesh with the at least one first zipper section of the first sidewall cover assembly, and the at least one second zipper section of the second sidewall cover assembly respectively. The at least one fourth zipper section of the headboard cover assembly mesh with the at least one first zipper section of the first sidewall cover assembly, and the at least one second zipper section of the second sidewall cover assembly respectively.

The cover bedding set assembly, further comprises a ceiling cover assembly comprising at least one fifth channel housing a fifth band assembly. The ceiling cover assembly further comprises at least one fifth zipper section. The at least one fifth zipper section of the ceiling cover assembly mesh with the at least one third zipper section of the footboard cover assembly, and the at least one fourth zipper section of the headboard cover assembly respectively.

It is therefore one of the main objects of the present invention to provide a cover bedding set assembly for beds.

It is another object of this invention to provide a cover bedding set assembly that transforms into defined shapes to resemble an automobile, boat, train, or plane as an example when assembled.

It is another object of this invention to provide a cover bedding set assembly comprising components and parts that secure to each other when assembled onto a bed.

It is another object of this invention to provide a cover bedding set assembly comprising components and parts that secure to each other primarily with hook and loop fasteners.

It is another object of this invention to provide a cover bedding set assembly that may be easily disassembled from a bed and collapsed for storage when not in use.

It is another object of this invention to provide a cover bedding set assembly that is volumetrically efficient for carrying, transporting, and storage.

It is another object of this invention to provide a cover bedding set assembly that can be readily assembled and disassembled without the need of any special tools.

It is another object of this invention to provide a cover bedding set assembly, which is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
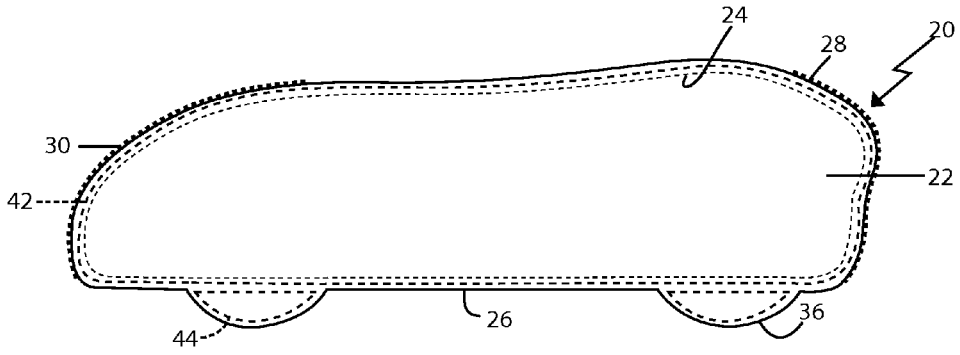
FIG. 1 is a side view of a first sidewall cover assembly, showing its exterior sidewall.

Referring now to the drawings, the present invention is generally referred to with numeral 10. It can be observed that the preferred embodiment basically includes sidewall cover assemblies 20 and 120, footboard cover assembly 220, ceiling cover assembly 320, and headboard cover assembly 420.

As seen in FIG. 1, sidewall cover assembly 20 comprises exterior sidewall 22, stitching 24, edges 26 and 36, and zipper sections 28 and 30. Positioned between stitching 24 and edge 26 is band 42. Sidewall cover assembly 20 also comprises band 44.

Figure 2:
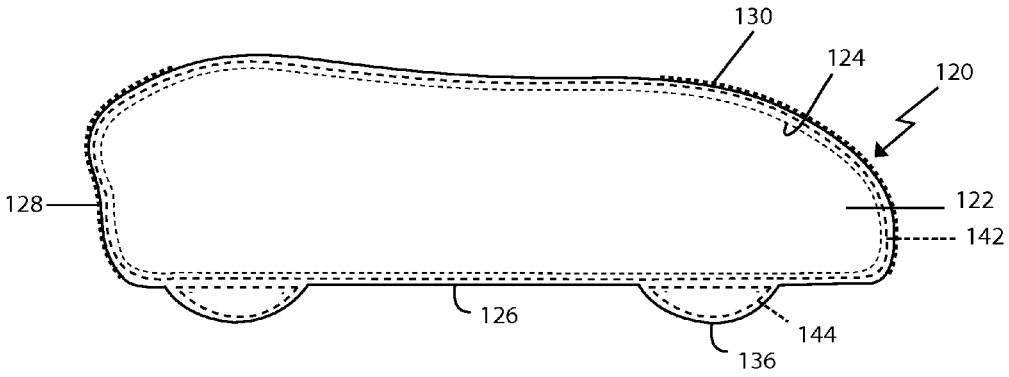
FIG. 2 is a side view of a second sidewall cover assembly, showing its exterior sidewall.

As seen in FIG. 2, sidewall cover assembly 120 comprises exterior sidewall 122, stitching 124, edges 126 and 136, and zipper sections 128 and 130. Positioned between stitching 124 and edge 126 is band 142. Sidewall cover assembly 120 also comprises band 144.

Figure 3:
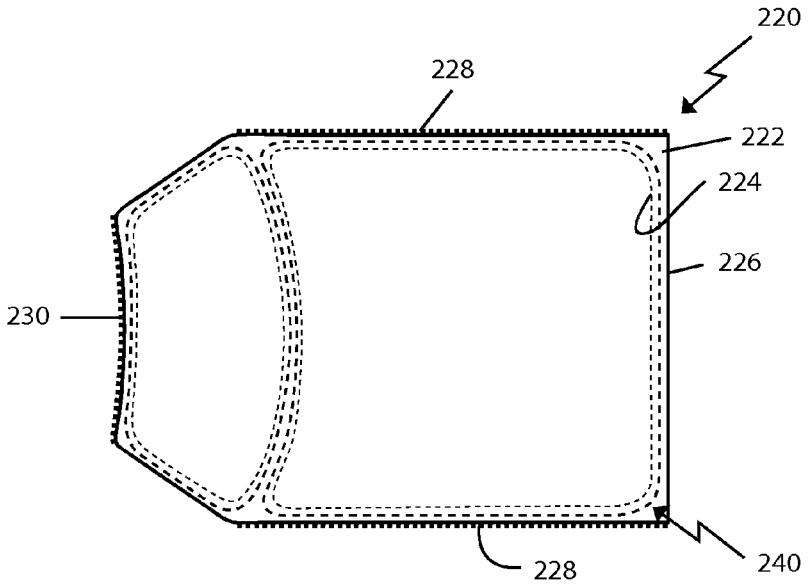
FIG. 3 is a top view of a footboard cover assembly, showing its exterior face.

As seen in FIG. 3, footboard cover assembly 220 comprises cover 222 with stitching 224, edge 226, and zipper sections 228 and 230. Footboard cover assembly 220 further comprises band assembly 240.

Figure 4:
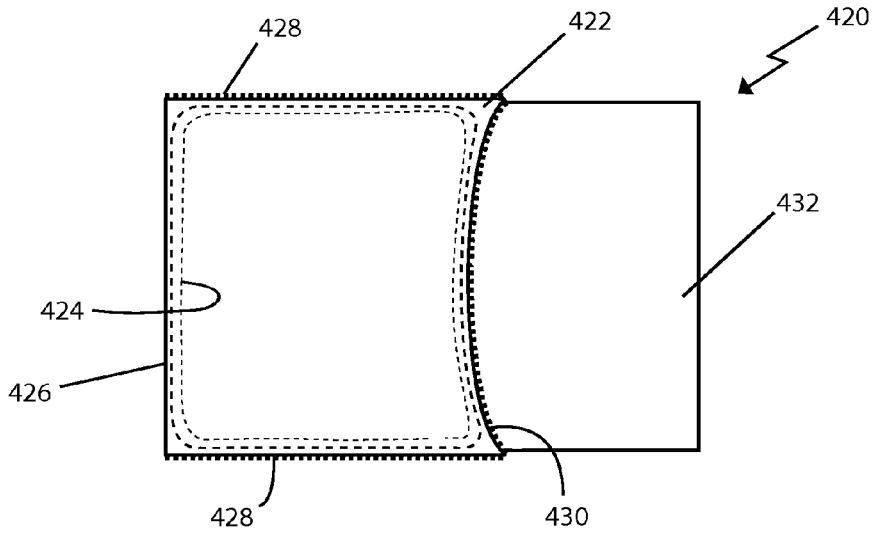
FIG. 4 is a top view of a headboard cover assembly, showing its exterior face.

As seen in FIG. 4, headboard cover assembly 420 comprises cover 422 with stitching 424, edge 426 and zipper sections 428 and 430. Headboard cover assembly 420 further comprises panel 432.

Figure 5:
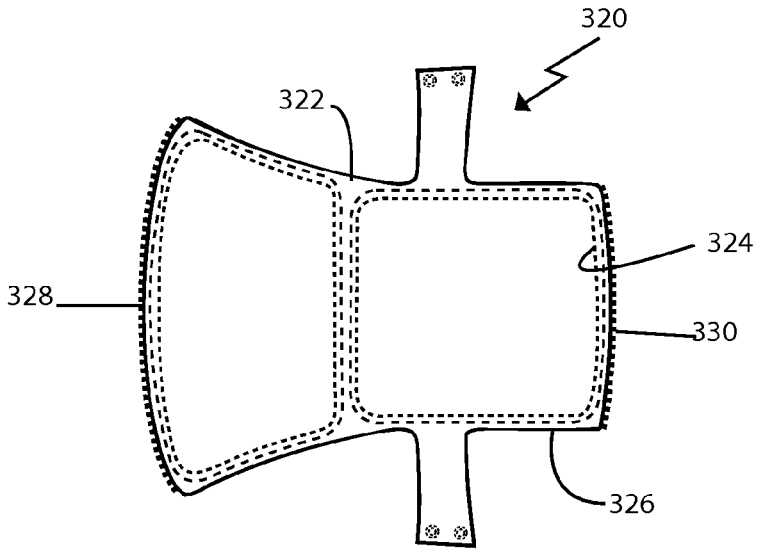
FIG. 5 is a top view of a ceiling cover assembly, showing its exterior face.

As seen in FIG. 5, ceiling cover assembly 320 comprises cover 322, stitching 324, edge 326, and zipper sections 328 and 330.

Figure 6:
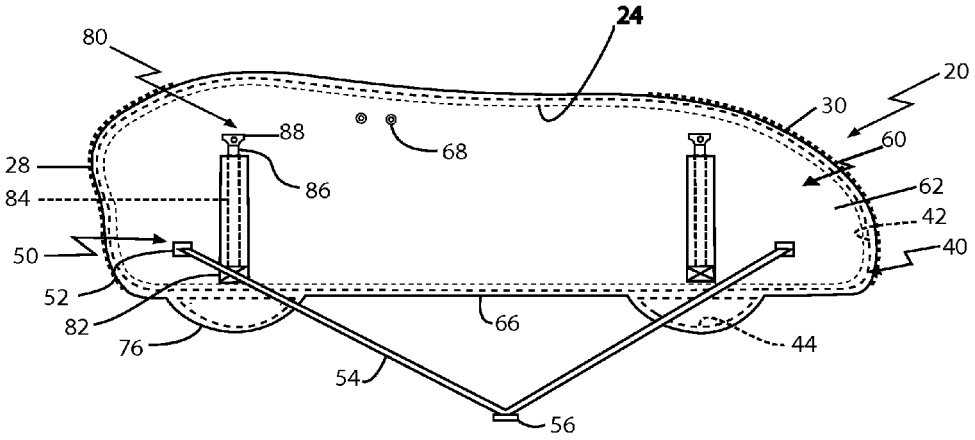
FIG. 6 is a side view of the first sidewall cover assembly seen in FIG. 1, showing its interior sidewall.

FIG. 6 shows the interior view of sidewall cover assembly 20. As seen, sidewall cover assembly 20 also comprises band assembly 40 and sidewall assembly 60. Band assembly 40 comprises bands 42 and 44. Sidewall assembly 60 comprises interior sidewall 62 with edges 66 and 76, and apertures 68. Sidewall cover assembly 20 further comprises lock strap assembly 50 and strap assembly 80. Lock strap assembly 50 comprises base 52, strap 54 and lock 56. Strap assembly 80 comprises base 82, sleeve 84, strap 86 and handle 88. It is noted that band assembly 40 is sandwiched between exterior sidewall 22 and interior sidewall 62.

Figure 7:
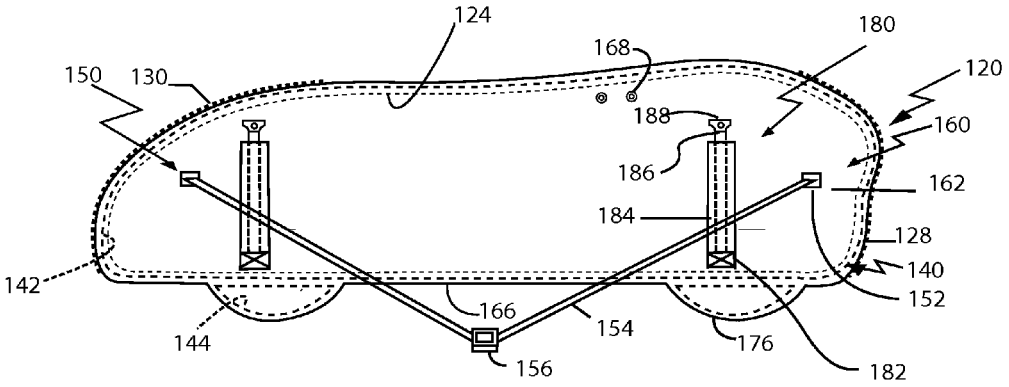
FIG. 7 is a side view of the second sidewall cover assembly seen in FIG. 2, showing its interior sidewall.

FIG. 7 shows the interior view of sidewall cover assembly 120. As seen, sidewall cover assembly 120 also comprises band assembly 140 and sidewall assembly 160. Band assembly 140 comprises bands 142 and 144. Sidewall assembly 160 comprises interior sidewall 162 with edges 166 and 176, and apertures 168. Sidewall cover assembly 120 further comprises lock strap assembly 150 and strap assembly 180. Lock strap assembly 150 comprises base 152, strap 154 and lock 156. Strap assembly 180 comprises base 182, sleeve 184, strap 186 and handle 188. It is noted that band assembly 140 is sandwiched between exterior sidewall 122 and interior sidewall 162. Locks 56 and 156 snap and/or secure to each other.

Figure 8:
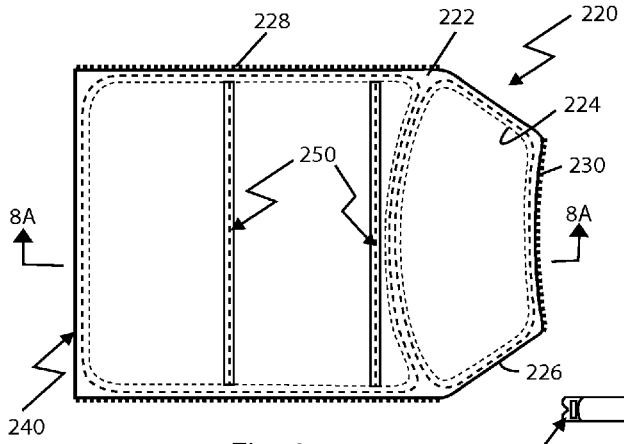
FIG. 8 is a bottom view of the footboard cover assembly seen in FIG. 3, showing its interior face.
Figure 8A:
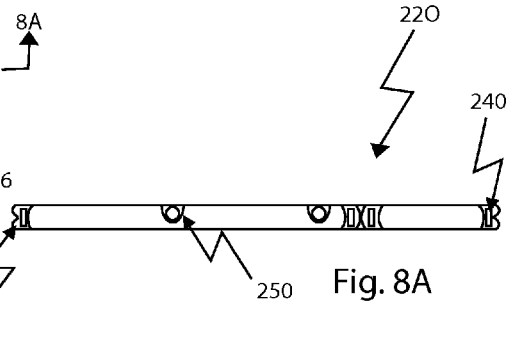
FIG. 8A is a cut view of the footboard cover assembly band assembly and a post assembly along the lines 8A-8A as seen in FIG. 8.

FIG. 8 shows the bottom view of footboard cover assembly 220, showing its interior face. As shown, footboard cover assembly 220 comprises cover 222, stitching 224, edge 226, and zipper sections 228 and 230. Footboard cover assembly also comprises band assembly 240 and post assembly 250, also shown in the side view of footboard cover assembly 220 represented in FIG. 8A.

Figure 9:
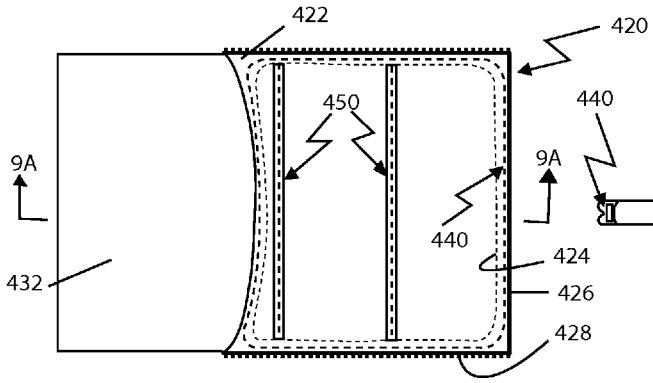
FIG. 9 is a bottom view of the headboard cover assembly seen in FIG. 4, showing its interior face.
Figure 9A:
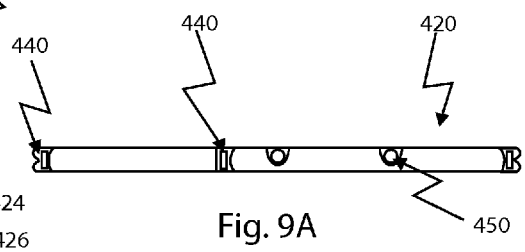
FIG. 9A is a cut view of the headboard cover assembly band assembly and a post assembly along the lines 9A-9A as seen in FIG. 9.

FIG. 9 shows the bottom view of headboard cover assembly 420, showing its interior face. As best seen in the side view represented in FIG. 9A, headboard cover assembly 420 further comprises band assembly 440 and post assembly 450.

Figure 10:
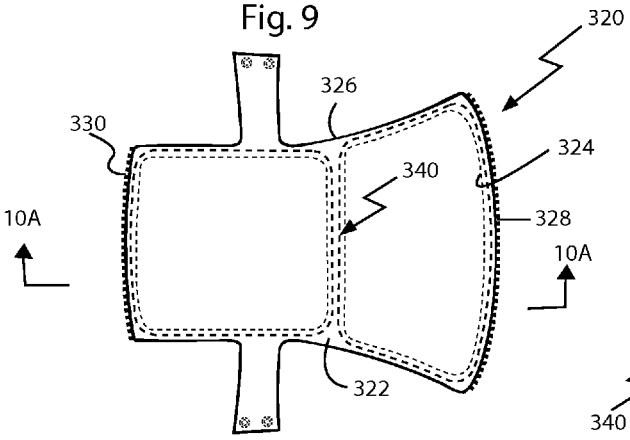
FIG. 10 is a bottom view of the ceiling cover assembly seen in FIG. 5, showing its interior face.
Figure 10A:
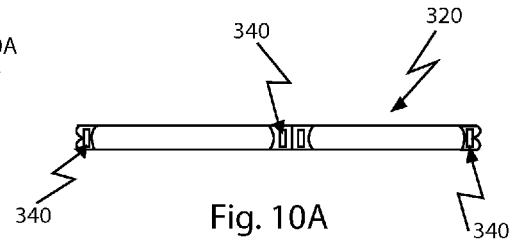
FIG. 10A is a cut view of a band assembly of the ceiling cover assembly along the lines 10A-10A as seen in FIG. 10.

FIG. 10 shows the bottom view of ceiling cover assembly 320, showing its interior face. As also seen in FIG. 10A, ceiling cover assembly 320 further comprises band assembly 340.

Figure 11:
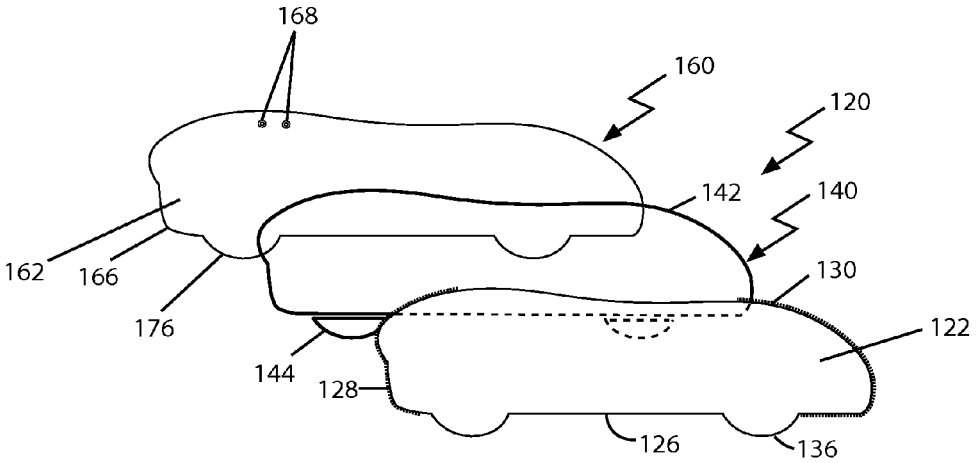
FIG. 11 is an exploded view of the second sidewall cover assembly seen in FIG. 2.

FIG. 11 is an exploded view of sidewall cover assembly 120. As shown, band assembly 140 is sandwiched between exterior sidewall 122 and sidewall assembly 160 when band assembly 140 is assembled. It is noted that the same applies for sidewall cover assembly 20, footboard cover assembly 220, ceiling cover assembly 320 and headboard cover assembly 420.

Figure 11A:
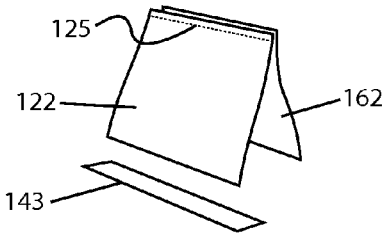
FIG. 11A is a first section view of the second sidewall cover assembly illustrating an area to receive a band assembly.

FIG. 11A show a section view of exterior sidewall 122 being attached with stitching 125 to interior sidewall 162 at a predetermined area.

Figure 11B:
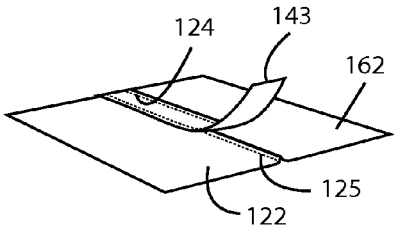
FIG. 11B is a second section view of the second sidewall cover assembly illustrating the area to receive the band assembly.

FIG. 11B show a section view of exterior sidewall 122 attached with stitching 125 to interior sidewall 162 and cover 143 being attached to their junction area with stitching 124.

Figure 11C:
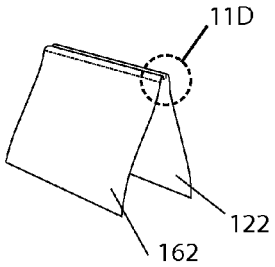
FIG. 11C is a third section view of the second sidewall cover assembly illustrating the area to receive the band assembly.
Figure 11D:
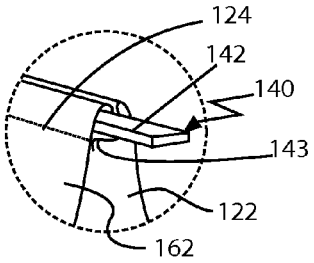
FIG. 11D is a fourth section view of the second sidewall cover assembly illustrating the area with the band assembly inserted therein.

FIG. 11C show section view of exterior sidewall 122 attached to interior sidewall 162 and cover 143 attached to their junction area. It is noted that once completed the attachment, exterior sidewall 122 and interior sidewall 162 are rotated as shown, to be in a position inverted to the position shown in FIG. 11A. At this position, cover 143 defines a channel to receive band assembly 140, which is inserted therein, as shown in FIG. 11D.

Band assemblies 40, 140, 240, 340 and 440 are made of a flexible and resilient material, that keep its shape when it is not being deformed by a force of a predetermined magnitude. It is also noted that, the attachment steps and exact disposition of exterior sidewall 122 attached to interior sidewall 162 and cover 143 described above and shown in FIGS. 11A, 11B, 11C and 11D, as an example provide a unique way for band assemblies 40, 140, 240, 340 and 440 to keep predetermined shapes for sidewall cover assemblies 20 and 120, footboard cover assembly 220, ceiling cover assembly 320 and headboard cover assembly 420, respectively, when the band assemblies are inserted into their respective channels.

Figure 12:
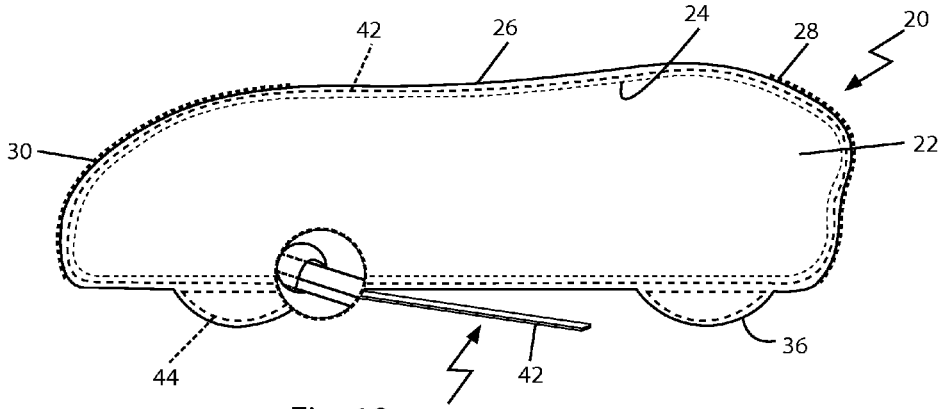
FIG. 12 is a side view of the first sidewall cover assembly seen in FIG. 1, showing its exterior sidewall and its band assembly.

As seen in FIG. 12, to assemble cover bedding set assembly 10, bands 42 and 44 are inserted through the channel defined by exterior sidewall 22, interior sidewall 62 (not shown in FIG. 12) and cover 43. In the same way, band assemblies 140, 240, 340 and 440 are inserted through respective channels defined by respective exterior sidewall, interior sidewall and cover.

Figure 13A:
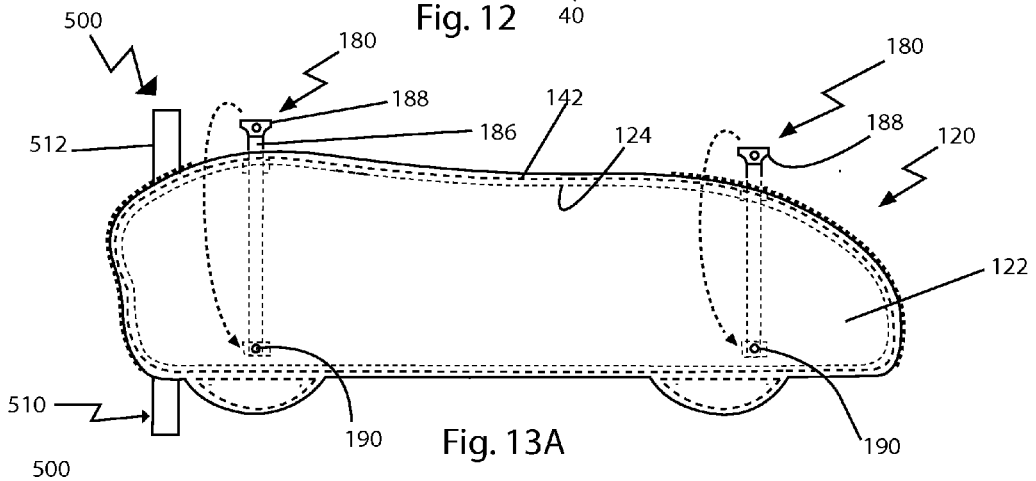
FIG. 13A is a side view of the second sidewall cover assembly seen in FIG. 2, showing its exterior sidewall and its strap assemblies in a first position.

Seen in FIG. 13A is sidewall cover assembly 120 showing its exterior sidewall 122 and its strap assemblies 180 in a first position. Strap assembly 180 further comprises snap 190 for handle 188 to secure to.

Figure 13B:
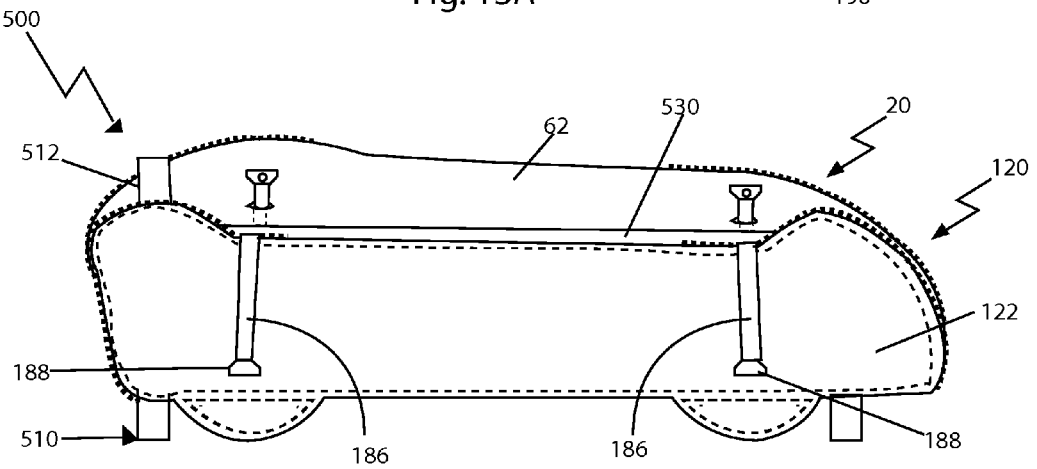
FIG. 13B is a side view of the second sidewall cover assembly seen in FIG. 13A, showing its exterior sidewall and its strap assemblies in a second position.

Seen in FIG. 13B is sidewall cover assembly 120 showing its exterior sidewall 122 and its strap assemblies 180 in a second position, whereby handle 188 has been secure to snap 190. This configuration is desirable to change sheets and/or a comforter of bed assembly 500 having mattress 530 or for facilitating the entry of a person onto bed assembly 500.

Figure 14A:
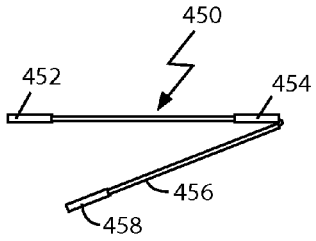
FIG. 14A is an isometric view of a disassembled post assembly.

FIG. 14A shows and isometric view of a disassembled post assembly 450. In the preferred embodiment, post assembly 450, also seen in FIG. 9A having a post or tubular shape, comprises ends 452 and 458, coupler 454 and post 456.

Figure 14B:
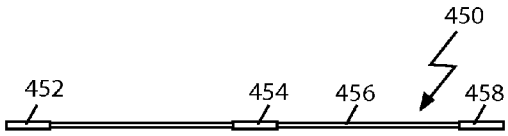
FIG. 14B is an isometric view of an assembled post assembly seen in FIG. 14A.

As seen in FIG. 14B, post assembly 450 is assembled.

Figure 14C:
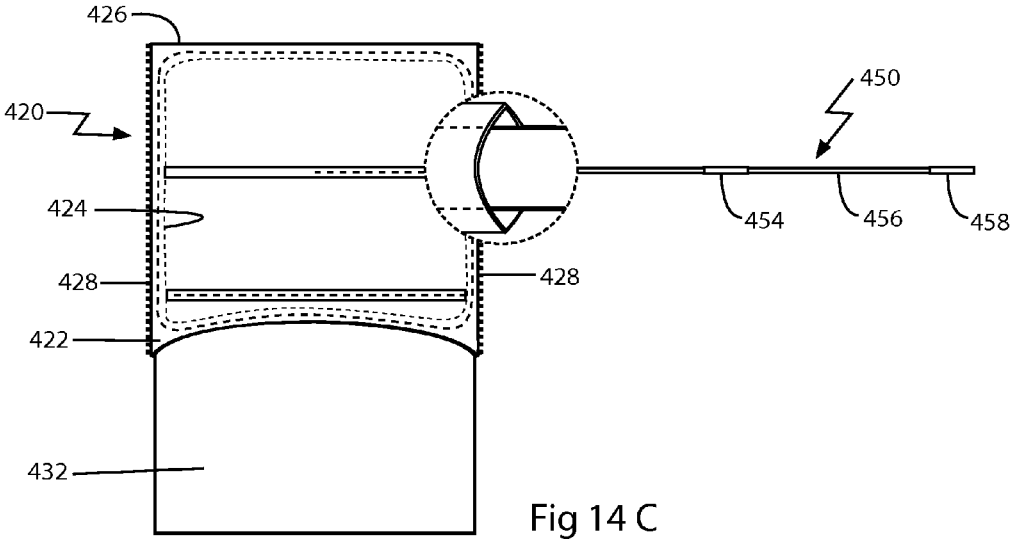
FIG. 14C is a bottom view of the headboard cover assembly seen in FIG. 9, showing its interior face and its post assembly.

As seen in FIG. 14C, as an example once post assembly 450 is assembled, it is inserted into transversal channels of headboard cover assembly 420.

As seen in FIGS. 15A, 15B, 15C, 15D, 15E, 15F, and 15G, instant invention 10 may be assembled onto any bed assembly 500. Such a bed assembly 500 may comprise headboard assembly 510 having posts 512 and headboard 514. Bed assembly 500 may also comprise footboard assembly 520 having posts 522 and footboard 524. In addition, bed assembly 500 may also comprise box spring 528 and mattress 530.

Figure 15A:
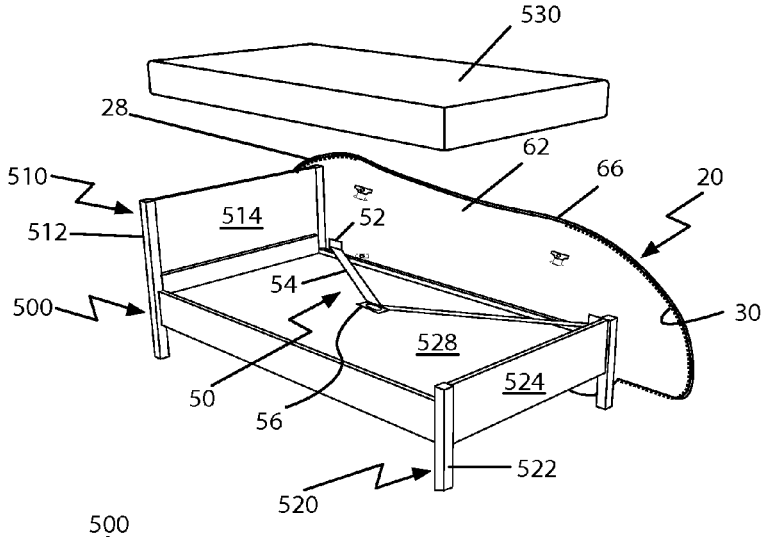
FIG. 15A is an isometric view of the first sidewall cover assembly, showing its interior sidewall being assembled onto a bed assembly.
Figure 15B:
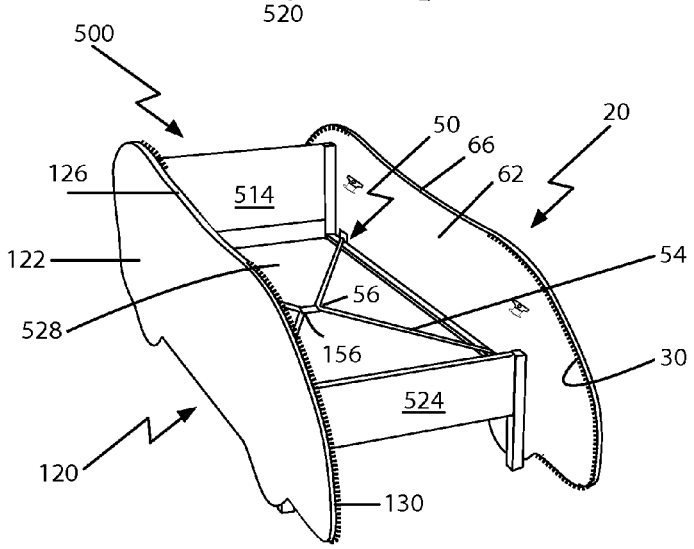
FIG. 15B is an isometric view of the second sidewall cover assembly being assembled onto the bed assembly.
Figure 15C:
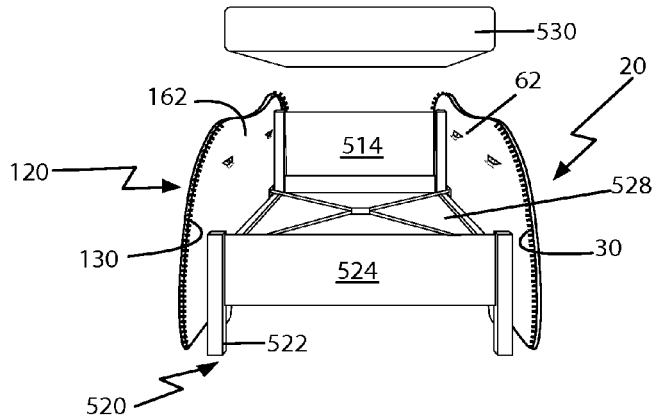
FIG. 15C is a front view of the first sidewall cover assembly secured to the second sidewall cover assembly, being assembled onto the bed assembly.

As seen in FIGS. 15A, 15B, and 15C, to assemble present invention 10 onto bed assembly 500, mattress 530 is elevated from box spring 528 to permit sidewall cover assemblies 20 and 120 to be installed, whereby locks 56 and 156 snap and/or secure to each other. Once snapped and/or secured to each other, mattress 530 is placed over box spring 528.

Figure 15D:
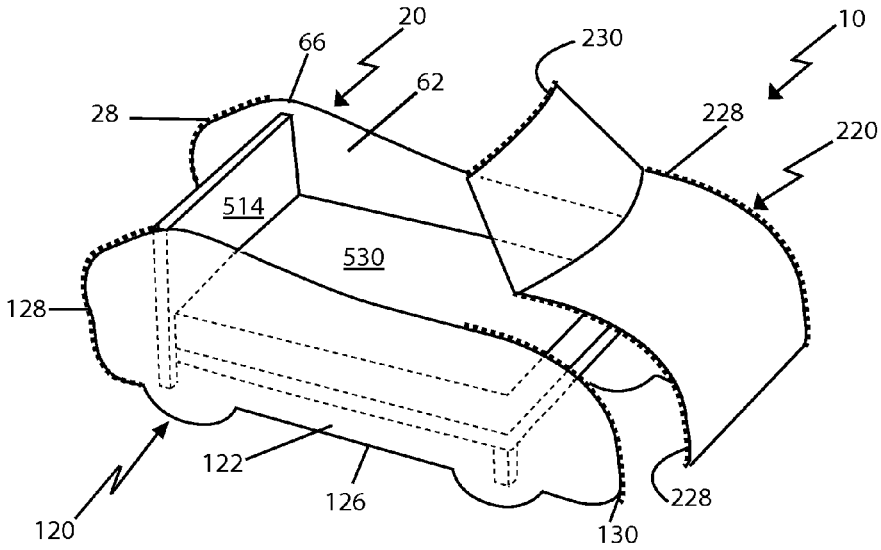
FIG. 15D is an isometric view of the footboard cover assembly being assembled onto the bed assembly.

As seen in FIG. 15D, footboard cover assembly 220 is installed, whereby zipper sections 228 mesh with zipper sections 130 respectively. Although not illustrated, it is noted that the zipper sections of present invention 10 comprise two rows of protruding teeth which may be made to interdigitate, linking the rows, carrying from tens to hundreds of specially shaped metal or plastic teeth. These teeth can be either individual or shaped from a continuous coil, and are also referred to as elements. The slider, operated by hand, moves along the rows of teeth. Inside the slider is a Y-shaped channel that meshes together or separates the opposing rows of teeth, depending on the direction of the slider's movement.

Figure 15E:
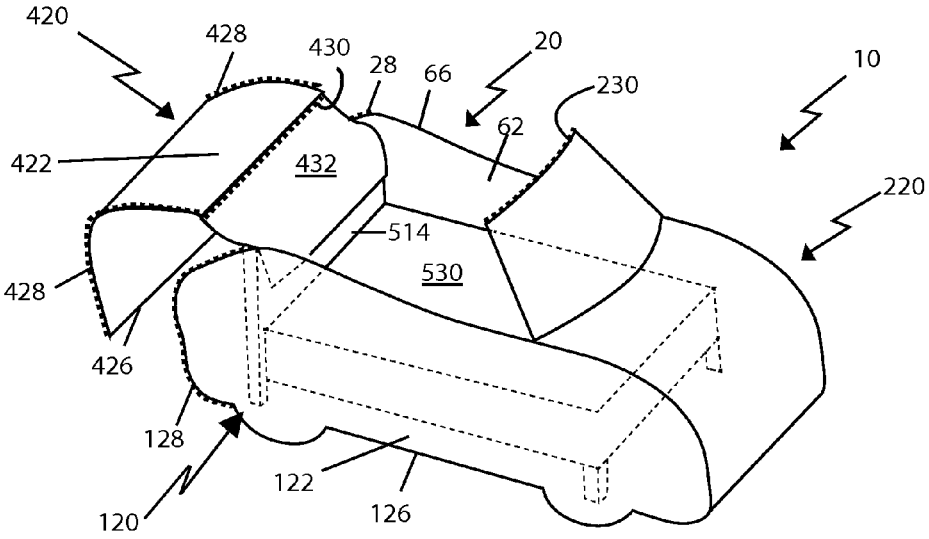
FIG. 15E is an isometric view of the headboard cover assembly being assembled onto the bed assembly.

As seen in FIG. 15E, headboard cover assembly 420 is installed, whereby zipper sections 428 mesh with zipper sections 128 respectively.

Figure 15F:
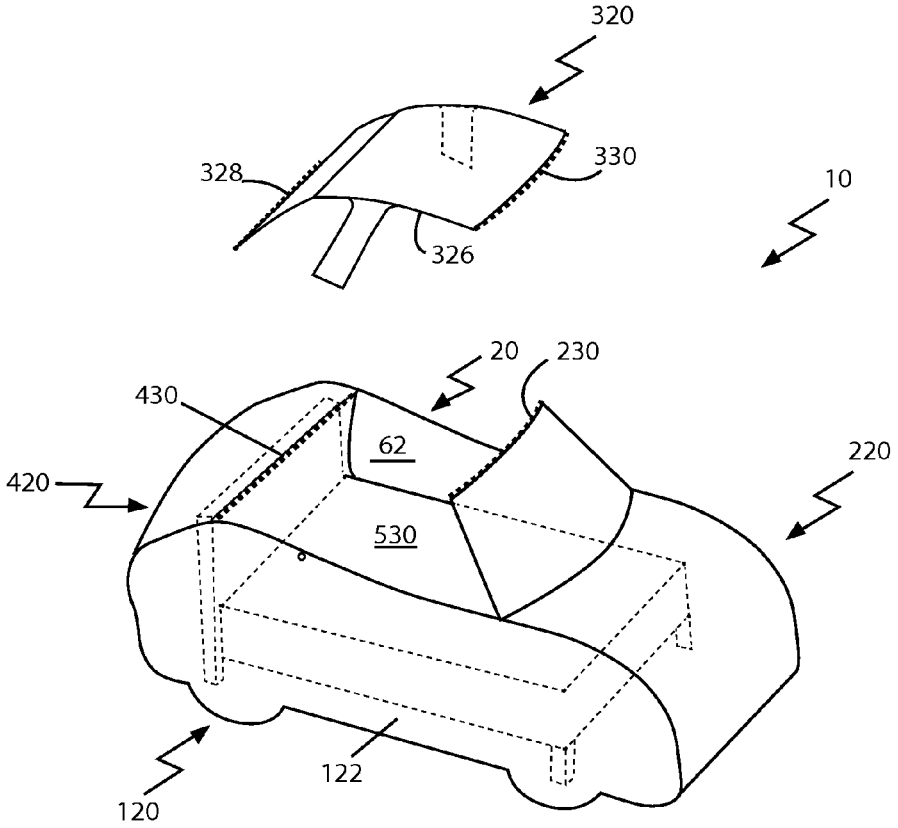
FIG. 15F is an isometric view of the ceiling cover assembly being assembled onto the bed assembly.
Figure 15G:
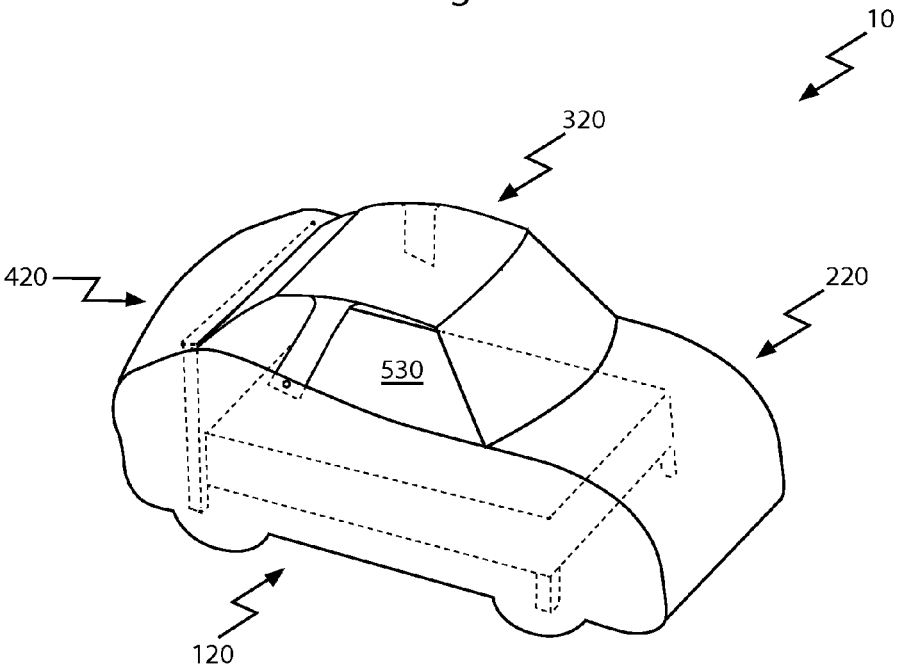
FIG. 15G is an isometric view of the instant invention assembled onto the bed assembly.

As seen in FIGS. 15F and 15G, ceiling cover assembly 320 is installed, whereby zipper sections 330 mesh with zipper sections 230, zipper sections 328 mesh with zipper sections 430 respectively.

Present invention 10 transforms into predetermined shapes to resemble an automobile, boat, train, or plane as an example when assembled. The channels within sidewall cover assemblies 20 and 120, footboard cover assembly 220, ceiling cover assembly 320, and headboard cover assembly 420 define the shapes with band assemblies 40, 140, 240, 340 and 440. The channels define the shapes, because band assemblies 40, 140, 240, 340 and 440 expand from internally to outwardly. Furthermore, band assemblies 40, 140, 240, 340 and 440 are made of a flexible and resilient material, that keep its shape when it is not being deformed by a force of a predetermined magnitude. In a preferred embodiment, the band assemblies are metallic. Present invention 10, and specifically sidewall cover assemblies 20 and 120, footboard cover assembly 220, ceiling cover assembly 320, and headboard cover assembly 420 may use hook and loop fasteners for additional means to attachment to each other.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A cover bedding set assembly, comprising:

A) first and second sidewall cover assemblies, said first sidewall cover assembly comprising at least one first channel housing a first band assembly, said second sidewall cover assembly comprising at least one second channel housing a second band assembly; further characterized in that said first and second sidewall cover assemblies comprise first and second locks that snap and/or secure to each other underneath a mattress;

B) a footboard cover assembly comprising at least one third channel housing a third band assembly; and C) a headboard cover assembly comprising at least one fourth channel housing a fourth band assembly, said first and second sidewall cover assemblies, said footboard cover assembly, and said headboard cover assembly transform into predetermined shapes to disguise a bed assembly when assembled, whereby said at least one first, second, third, and fourth channels define a shape of said first, second, third, and fourth band assemblies housed within, said first, second, third, and fourth band assemblies expand outwardly within said at least one first, second, third, and fourth channels respectively and follow a same curvature, whereby said first, second, third, and fourth band assemblies are made of a flexible and resilient material.

2. The cover bedding set assembly set forth in claim 1, further characterized in that said first, second, third, and fourth band assemblies are made of a flexible and resilient material that keep their shape when not being deformed by a force of a predetermined magnitude.

3. The cover bedding set assembly set forth in claim 1, further characterized in that said first, second, third, and fourth band assemblies are made of a metallic material.

4. The cover bedding set assembly set forth in claim 1, further characterized in that said first and second sidewall cover assemblies, said footboard cover assembly, and said headboard cover assembly are assembled onto said bed assembly.

5. The cover bedding set assembly set forth in claim 4, further characterized in that said bed assembly comprises a headboard assembly having posts and a headboard.

6. The cover bedding set assembly set forth in claim 4, further characterized in that said bed assembly comprises a footboard assembly having posts and a footboard.

7. The cover bedding set assembly set forth in claim 4, further characterized in that said bed assembly comprises a box spring and said mattress.

8. The cover bedding set assembly set forth in claim 1, further characterized in that said first sidewall cover assembly further comprises at least one first zipper section, and said second sidewall cover assembly further comprises at least one second zipper section.

9. The cover bedding set assembly set forth in claim 8, further characterized in that said footboard cover assembly further comprises at least one third zipper section.

10. The cover bedding set assembly set forth in claim 9, further characterized in that said headboard cover assembly further comprises at least one fourth zipper section.

11. The cover bedding set assembly set forth in claim 10, further characterized in that said at least one third zipper section of said footboard cover assembly mesh with said at least one first zipper section of said first sidewall cover assembly, and said at least one second zipper section of said second sidewall cover assembly respectively.

12. The cover bedding set assembly set forth in claim 11, further characterized in that said at least one fourth zipper section of said headboard cover assembly mesh with said at least one first zipper section of said first sidewall cover assembly, and said at least one second zipper section of said second sidewall cover assembly respectively.

13. The cover bedding set assembly set forth in claim 12, further comprising:

D) a ceiling cover assembly comprising at least one fifth channel housing a fifth band assembly.

14. The cover bedding set assembly set forth in claim 13, further characterized in that said ceiling cover assembly further comprises at least one fifth zipper section.

15. The cover bedding set assembly set forth in claim 14, further characterized in that said at least one fifth zipper section of said ceiling cover assembly mesh with said at least one third zipper section of said footboard cover assembly, and said at least one fourth zipper section of said headboard cover assembly respectively.

16. A cover bedding set assembly, comprising:

A) first and second sidewall cover assemblies, said first sidewall cover assembly comprising at least one first channel housing a first band assembly, said second sidewall cover assembly comprising at least one second channel housing a second band assembly;

B) a footboard cover assembly comprising at least one third channel housing a third band assembly; and C) a headboard cover assembly comprising at least one fourth channel housing a fourth band assembly, said first and second sidewall cover assemblies, said footboard cover assembly, and said headboard cover assembly transform into predetermined shapes to disguise a bed assembly when assembled, whereby said at least one first, second, third, and fourth channels define a shape of said first, second, third, and fourth band assemblies housed within, said bed assembly comprises a mattress and said first and second sidewall cover assemblies comprise first and second locks that snap and/or secure to each other underneath said mattress.

17. The cover bedding set assembly set forth in claim 16, further characterized in that said first, second, third, and fourth band assemblies are made of a flexible and resilient material.

18. The cover bedding set assembly set forth in claim 16, further characterized in that said first and second sidewall cover assemblies, said footboard cover assembly, and said headboard cover assembly are assembled onto said bed assembly.

* * * * *